US005918820A

United States Patent [19]

Ikeda et al.

[11] Patent Number: 5,918,820

[45] Date of Patent: Jul. 6, 1999

[54] HEAT EXCHANGER RECYCLING METHOD AND CRUSHING APPARATUS USED FOR THE SAME

[75] Inventors: Yasunari Ikeda, Omiyashi; Yoshiaki Arai, Tokyo, both of Japan

[73] Assignee: Mitsubishi Materials Corporation, Tokyo, Japan

[21] Appl. No.: 08/934,342

[22] Filed: Sep. 19, 1997

[51] Int. Cl.[6] ..... B02C 19/12

[52] U.S. Cl. ..... 241/24.13; 241/74

[58] Field of Search ..... 241/73, 188.1, 241/74, 27, 24.13, 24.15

[56] References Cited

U.S. PATENT DOCUMENTS

| | | | |
|---|---|---|---|
| 1,047,356 | 12/1912 | Williams | 241/188.1 |
| 3,329,350 | 7/1967 | Wisgerhof et al. | 241/188.1 |
| 3,670,973 | 6/1972 | Lucas | 241/188.1 |
| 4,009,834 | 3/1977 | Hahn et al. | 241/74 |

FOREIGN PATENT DOCUMENTS

| | | | |
|---|---|---|---|
| 2440345 | 3/1975 | Germany | 241/188.1 |
| 8-11022 | 1/1996 | Japan . | |
| 9-57144 | 3/1997 | Japan . | |
| 9-57145 | 3/1997 | Japan . | |
| 9-155213 | 6/1997 | Japan . | |
| 1175546 | 8/1985 | U.S.S.R. | 241/188.1 |
| 1576198 | 7/1990 | U.S.S.R. | 241/188.1 |

*Primary Examiner*—Mark Rosenbaum
*Attorney, Agent, or Firm*—Oblon, Spivak, McClelland, Maier & Neustadt, P.C.

[57] ABSTRACT

A method for recycling a heat exchanger includes spreading the outer periphery of a metal pipe of a heat exchanger in a predetermined direction, and placing the heat exchanger in the rotary space of a crushing roll which rotates around the axis thereof while slanting at a predetermined angle in order to separate the heat exchanger to the metal pipe and radiating metal fins. The crushing apparatus is provided with a crushing assembly which incorporates a processing space extending at a downward slant at a predetermined angle, an inlet, and a crushing roll applied to the heat exchanger which is rotated about the axis thereof in the processing space and moving down the same.

11 Claims, 11 Drawing Sheets

HEAT EXCHANGER RECYCLING METHOD AND CRUSHING APPARATUS USED FOR THE SAME

BACKGROUND OF THE INVENTION

1. Field of the Invention

The present invention relates to a recycling method for a heat exchanger incorporated in an air conditioner or the like. The present invention also relates to a crushing apparatus used for a heat exchanger to separate a metal pipe, through which a refrigerant passes, and a radiating metal fin surrounding the metal pipe.

2. Description of Related Art

A heat exchanger built in an air conditioner or the like is composed mainly of pipes made of high-purity copper and a heat radiating assembly which employs aluminum radiating metal fins. The copper pipes are inserted in the heat radiating assembly, then the inside diameters of the copper pipes are spread by metal fittings, or a gas or the like so as to connect them together by contact bonding.

Such heat exchangers have been disposed of as industrial wastes because it has been difficult to draw out the copper pipes from the heat radiating assemblies when recycling the heat exchangers and because the copper pipes and the heat radiating assemblies together would hardly find themselves usable in the alloy applications.

There has been known a method disclosed in Japanese Unexamined Patent Publication No. 8-11022, wherein the outer periphery or peripheries of a single or a plurality of metal pipes, which have penetrated in a plurality of radiating metal fins at predetermined intervals in a heat exchanger, are expanded in a predetermined direction.

As more air conditioners or the like are consumed, however, the quantity of dumped heat exchangers has accordingly been increasing, and there have been social demands for establishing a method for recycling the heat exchangers.

Using impact crushers employed for general recycling processes as the crushing apparatuses for scrapping heat exchangers has been posing the problem set forth below.

The impact crushers inevitably apply external mechanical forces to heat exchangers when they crush them by using high impact. This tends to easily produce metallic powder at the time of impacting, and the metallic powder sticks to impact marks and it cannot be removed easily, with a consequent danger of the contamination by impurities; hence, the impact crushers have not been suitably used as the crushing apparatuses for heat exchangers from which high purity copper need to be recovered.

Regular shredding machines could be used because they are capable of performing consecutive processing. The regular shredding machines, however, are not able to prevent the contamination by impurities and they smash both copper pipes and radiating metal fins into very small pieces, making it difficult to separate these two different materials afterwards, resulting in low quality of recovered materials.

SUMMARY OF THE INVENTION

The present invention has been made with a view toward solving the problems with the prior art described above, and it is an object of the present invention to provide a recycling method for a heat exchanger, which method permits radiating metal fins and metal pipes of a heat exchanger to be easily separated at low cost.

It is another object of the present invention to provide a new crushing apparatus which is suitably used in the foregoing recycling method for a heat exchanger and which is capable of separating a large volume of radiating metal fins and metal pipes of heat exchangers in succession.

To these ends, according to one aspect of the present invention, there is provided a heat exchanger recycling method whereby:

a heat exchanger is fed into a rotary space of a crushing roll which rotates about the axis while inclining at a predetermined angle so as to separate the heat exchanger to a metal pipe or pipes and radiating metal fins;

in a process for spreading the outer periphery or peripheries of a single or a plurality of metal pipes penetrating at predetermined intervals in a plurality of radiating metal fins of a heat exchanger in a predetermined direction.

According to the heat exchanger recycling method, the outer periphery of a metal pipe of a heat exchanger is spread in a predetermined direction first by, for example, rolling. This causes the radiating metal fin to be crushed or torn in the spreading direction, e.g. from the side of the inner wall of a through hole.

Then, the heat exchanger is placed in the rotary space of the crushing roll which is rotating about the axis thereof at the predetermined angle to apply impact to the heat exchanger by the rotary force of the crushing roll, thus enabling the radiating metal fin to be easily separated from the metal pipe. Since the heat exchanger has been crushed or torn in the preceding process, a relatively small impact force is required of the crushing roll hence the apparatus can be made smaller and the separating efficiency can be improved.

According to another aspect of the present invention, there is provided a crushing apparatus for a heat exchanger, which is equipped with: a crushing assembly which internally incorporates a processing space extending aslant downward at a predetermined angle; an inlet which opens on the side of the top of the crushing assembly and through which a heat exchanger is fed; and a crushing roll which rotates about the axis thereof in the crushing assembly and which is applied to the heat exchanger fed through the inlet and lowered into the processing space; wherein the crushing roll is provided with a shaft assembly which extends in the inclining direction of the processing space and which rotates about the axis thereof, and a plurality of blades which are projected radially around the circumference of the shaft assembly in multiple rows in the lengthwise direction of the shaft assembly, and each of which turns in the processing space as the shaft assembly rotates so as to hit the heat exchanger that is moving down.

According to the heat exchanger crushing apparatus, a heat exchanger is first fed through the inlet provided at the top of the crushing assembly. The heat exchanger has been subjected to, for example, rolling or the like to spread the outer periphery of a metal pipe thereof in a predetermined direction. This causes a crack or tear in a radiating metal fin beforehand so that the radiating metal fin is in weak connection with a metal pipe attached thereto.

The heat exchanger which has been put in the crushing assembly moves downward while being gradually scrapped. To be more specific, when the blades come into contact with the heat exchanger, the radiating metal fins which have come into contact with the blades come off, and the removed radiating metal fins which have been formed into pieces move downward. The heat exchanger which is still relatively large is easily moved upward by being scrapped by the turning blades. The heat exchanger slowly moves aslant downward as it is repetitively moved up and down, during which the heat exchanger is evenly hit many times by the blades and gradually grows smaller since the blades turn at relatively high speed and they are projected in multiple rows in the direction of the axial center of the shaft assembly. The tilt angle of the crushing assembly, the number of revolutions of the crushing roll, the layout and number of the blades, etc. are preset to such values that allow a heat exchanger to be completely scrapped by the time it finishes moving aslant downward in accordance with, for example, the size or the degree of scrapping of the heat exchanger.

Preferably, the inner peripheral wall of the crushing assembly is provided with a single or a plurality of protuberances jutting out in the processing space. The protuberance or protuberances make it possible to apply further impact to the heat exchanger which, for instance, has been hit by the blade or blades and bounced outward so as to bring it back into the rotary space of the crushing roll. Thus, the scrapping efficiency of the crushing apparatus can be improved and the apparatus can be made even smaller.

Further preferably, the peripheral wall of the crushing section should be arranged so that it is capable of axial rotation, independently of the crushing roll, by using a motor. This will further improve the scrapping efficiency.

It is also possible to provide the crushing apparatus with a "screening" function. In this case, the slant bottom area of the peripheral wall or the entire peripheral wall of the crushing assembly employs a double-wall system composed of an inner wall, which has many meshes that allow radiating metal fins to pass therethrough but block metal pipes, and an outer wall; and at the bottom side of the dual wall, a port for recovering metal pipes which communicates the processing space inside the inner wall to the outside of the apparatus, and a port for recovering radiating metal fins which communicates the internal space of the dual wall to the outside of the apparatus. As previously described, since the processing space in the crushing assembly is inclined, the metal pipes and the radiating metal fins are naturally ejected through the metal pipe recovering port and the radiating metal fin recovering port, respectively, in this apparatus. In order to allow such screening to be accomplished smoothly, the inclined bottom area may be vibrated, the inner wall or the entire peripheral wall may be turned, or other means may be taken, thus enabling still higher efficiency of sorting and recovery to be achieved.

As is obvious from the above description, the scrapping or screening efficiency of the apparatus is greatly dependent on the angle of the inclination of the processing space. Hence, providing the crushing section of the crushing apparatus with a tilt angle adjusting means to permit a predetermined angles to be set will be especially convenient when an adjustment is necessary to shorten processing time or to improve the quality of parts recovered from scrapped heat exchangers.

DESCRIPTION OF THE PREFERRED EMBODIMENTS

In the heat exchanger recycling method in accordance with the present invention, a heat exchanger is subjected to predetermined preprocessing before it is rolled so as to permit easier scrapping of the heat exchanger. The heat exchanger is then broken into pieces, and the pieces are sorted and in the last step to recover the materials to be recycled.

The heat exchanger recycling method will now be described step by step.

Preprocessing

Figure 2:
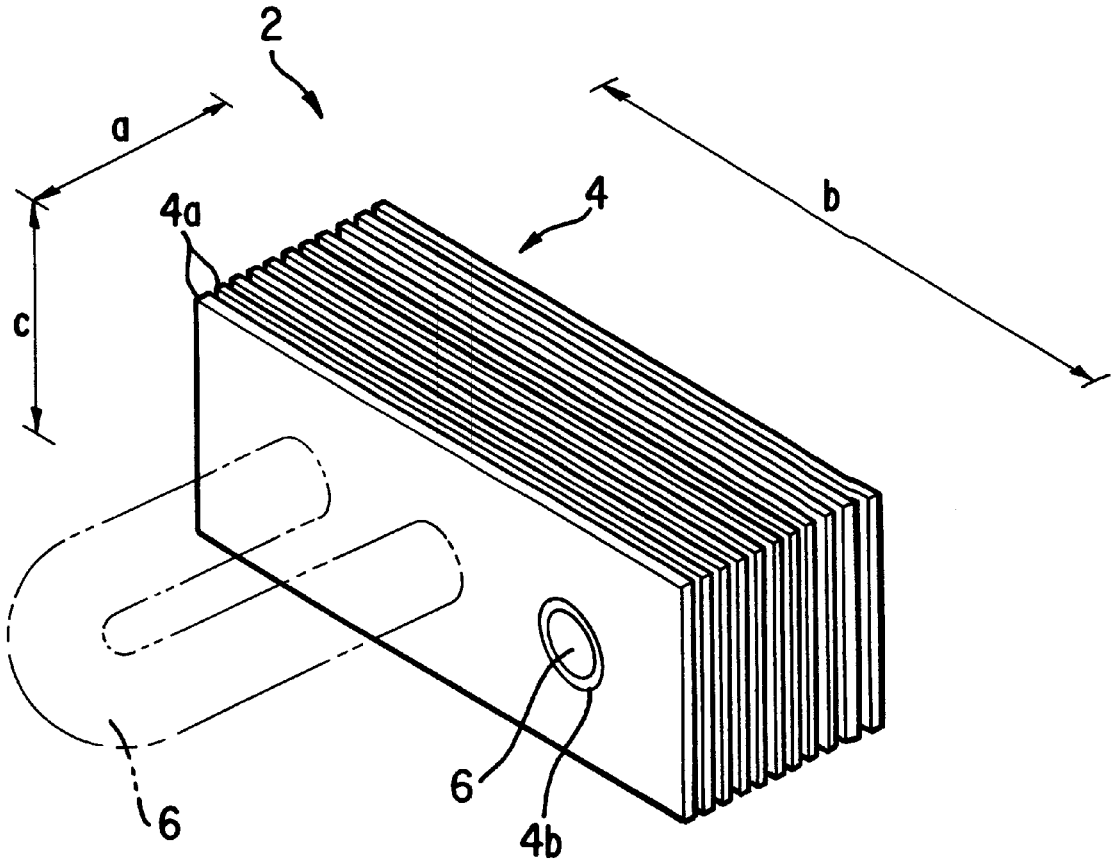
FIG. 2 is a perspective view of a heat exchanger which has been cut out.
Figure 3:
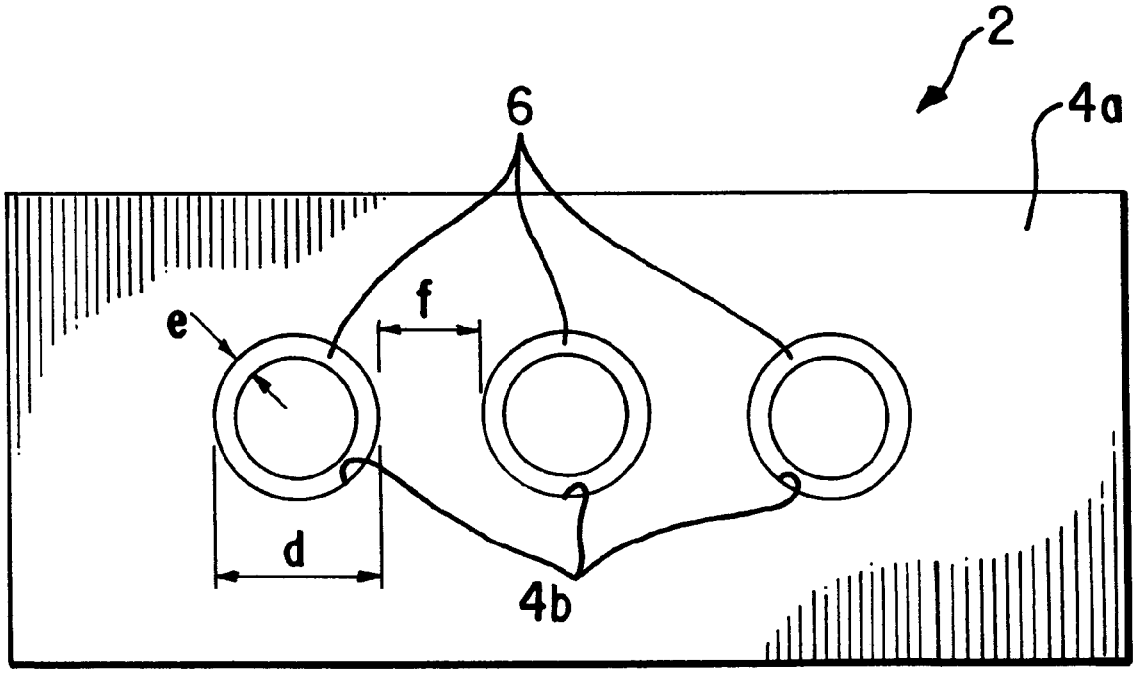
FIG. 3 is a side view of the heat exchanger which has been cut out.

First, the preprocessing is carried out on a heat exchanger before scrapping the heat exchanger by the recycling method according to the present invention. FIG. 2 is a perspective view illustrating a heat exchanger which has been cut out; and FIG. 3 is a side view illustrating the heat exchanger which has been cut out.

In general, a heat exchanger is incorporated in an outdoor and an indoor unit(s) of an air conditioner or other similar equipment wherein it is supported by support metal fittings made of iron, etc. The size of the heat exchanger changes depending on the equipment in which it is installed or the type of the heat exchanger; therefore, in order to make the subsequent processing easier, the heat exchanger is first cut out of a predetermined dimension. At this time, if the heat exchanger still has the support metal fittings unremoved and if the support metal fittings are made of a different material from that of the heat exchanger main body, then the support metal fittings are cut off by using a hand grinder, a saw, or other means. The support metal fittings made of a different material are removed beforehand because the support metal fittings would be intertwined with the heat exchanger main body and become hard to remove if they were rolled together with the main body, resulting in a lower quality of the recovered materials. If there are any other parts which are made of a different material from the parts to be recovered, they are to be removed in the similar manner beforehand.

As shown in FIG. 2, a heat exchanger 2 which has been cut out has a radiating assembly 4 composed of a plurality of radiating metal fins 4*a* made of aluminum or the like which are disposed adjacently at predetermined intervals, and a copper pipe 6. Each of the radiating metal fins 4*a* has through holes 4*b* which are arranged linearly at predetermined intervals, and the copper pipe 6 is inserted in each of the through holes 4*b* as shown in FIG. 3.

In some types of heat exchangers, the heat exchanger 2, which has been cut out, has a thickness exceeding the thickness that can be processed by rolling which will be discussed later. In such a case, before or after cutting out the heat exchanger 2, the entire heat exchanger or only the distal end portion to be rolled may be formed by pressing to a processable thickness in this preprocessing step. In some cases, the roll gap which will be described later can be increased at the time of rolling to accommodate The thickness, thus obviating the need for press-forming; however, adjusting the thickness of the heat exchanger to a certain extent in advance is more convenient because it eliminates the need for changing the gap in multiple steps according to the thick ness of the heat exchanger.

Figure 4:
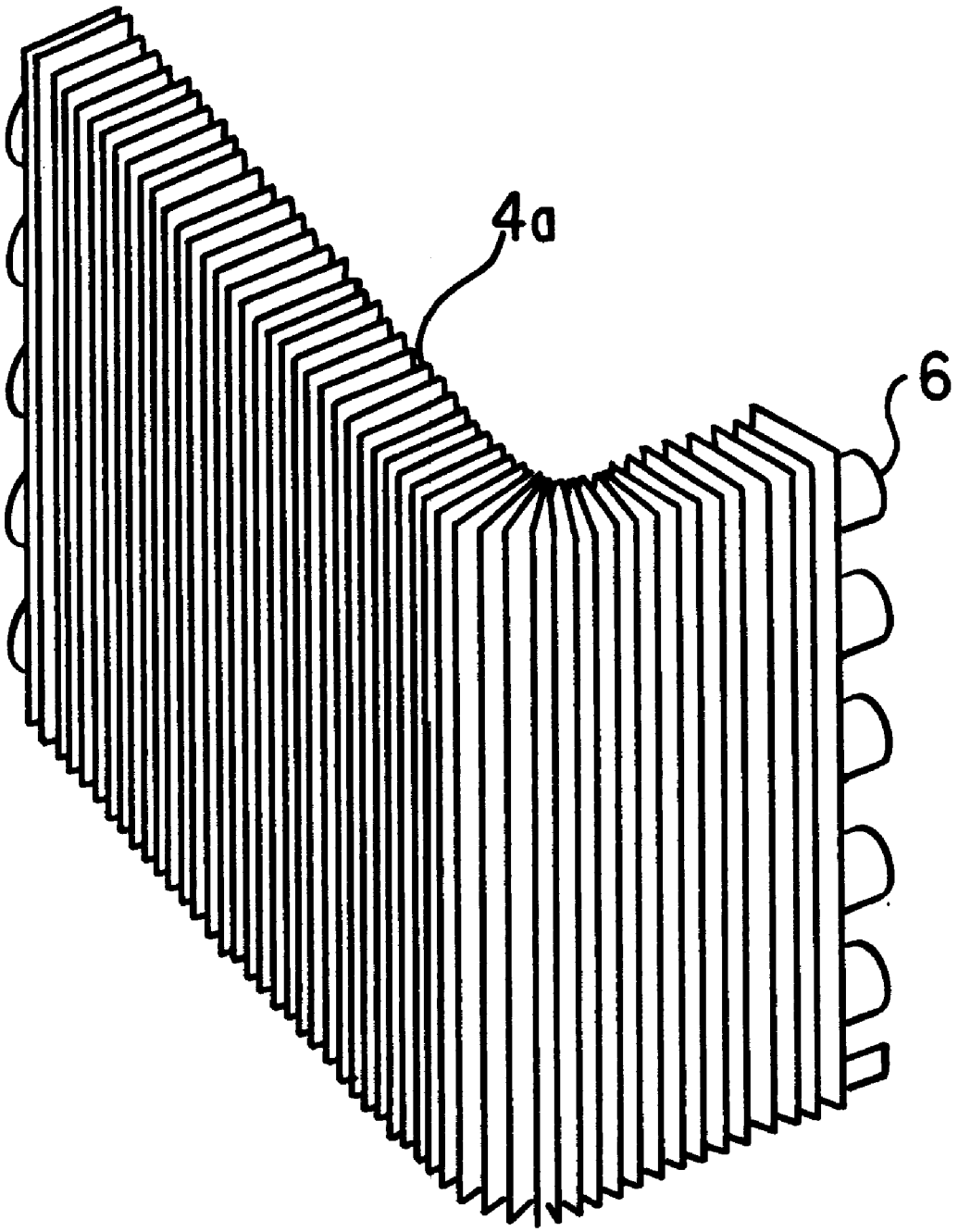
FIG. 4 is a perspective view illustrative of the appearance of another heat exchanger to which a heat exchanger recycling method in accordance with the present invention is applied.

The press-forming is carried out for shaping in addition to adjusting the thickness. If the heat exchanger has an L shape, V shape, U shape, etc. as shown in FIG. 4 rather than a flat shape, then the heat exchanger is pressed flat before it is subjected to rolling. The press-forming does not affect the subsequent crushing step or sorting step.

Rolling

The heat exchanger 2 which has been cut out in the predetermined size and from which the support metal fittings, etc. have been removed as described above is carried by a predetermined carrying mechanism toward a rolling machine in such a manner that the axial center of the copper pipe 6 is approximately parallel with the rotary shaft of the roller of the rolling machine. The heat exchanger 2 thus carried is rolled to be flattened in the carrying direction by the rolling machine.

Each radiating metal fin 4*a* rolled by the rolling machine develops cuts on both top and bottom surfaces thereof along the copper pipe 6. At this stage, the radiating metal fin 4*a* is in weak contact with the copper pipe 6 after having been pressed by the roller.

The rolling process set forth above and the screening process which will be discussed later are already known by the disclosure in the foregoing Japanese Unexamined Patent Publication No. 8-11022.

Crushing

Figure 1A:
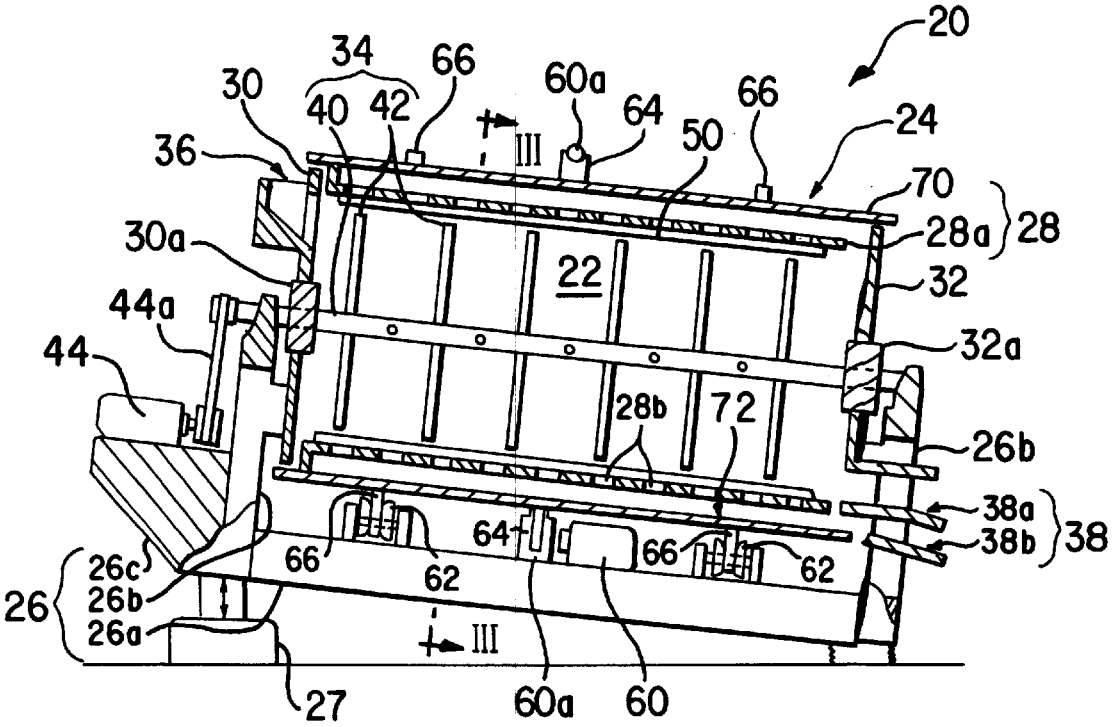
FIG. 1A is a lengthwise, longitudinal sectional view illustrating a crushing apparatus in accordance with a fourth embodiment of the present invention.
Figure 1B:
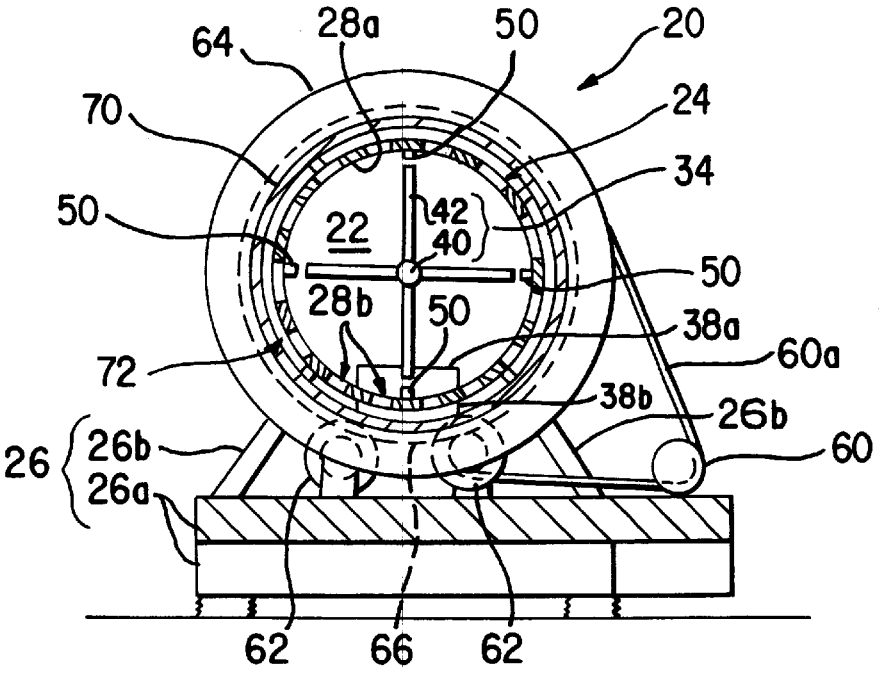
FIG. 1B is a longitudinal sectional view at the line III—III of FIG. 1A.
Figure 5A:
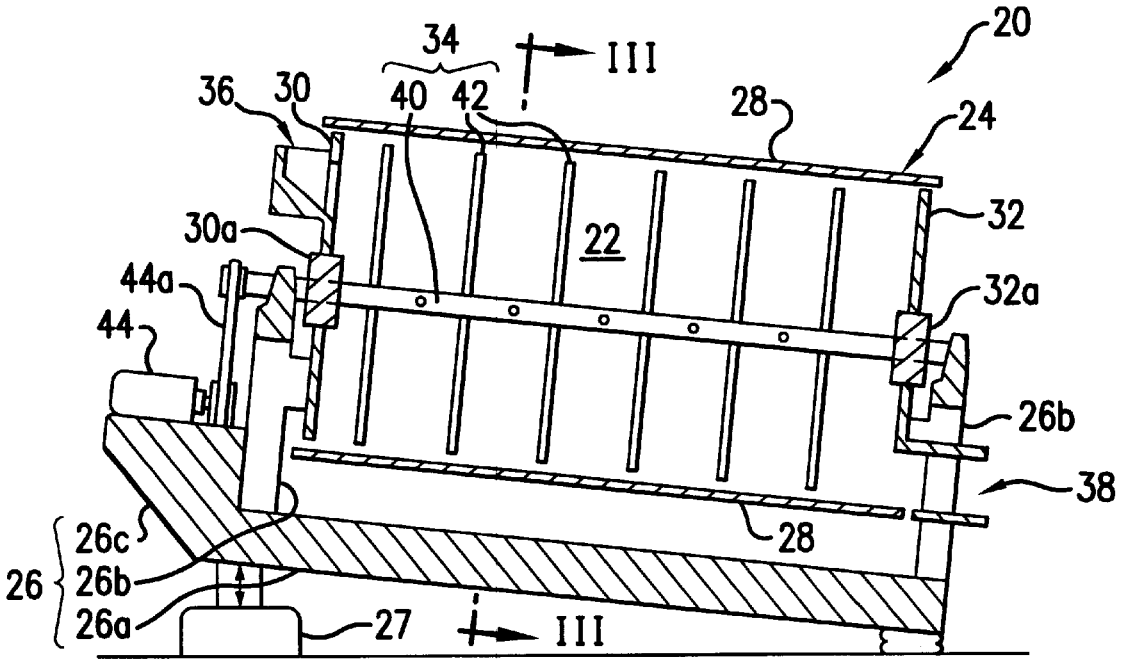
FIG. 5A is a lengthwise, longitudinal sectional view illustrating a crushing apparatus in accordance with a first embodiment of the present invention.
Figure 5B:
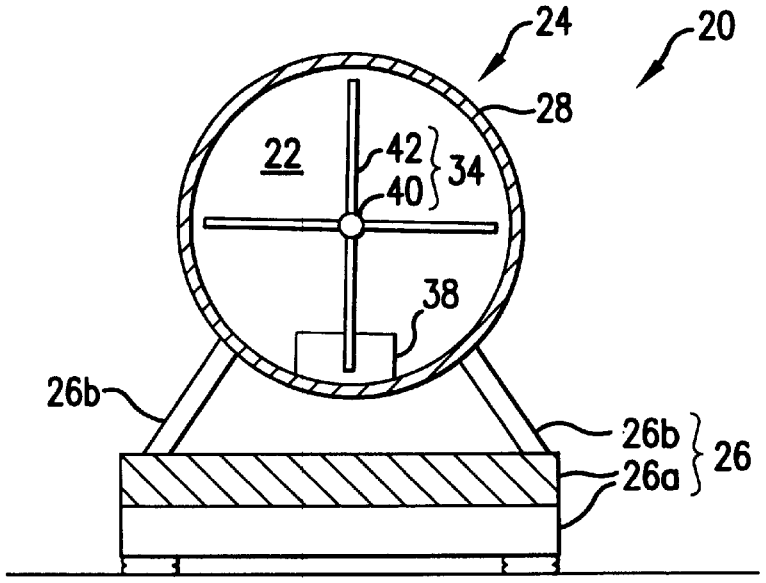
FIG. 5B is a longitudinal sectional view at the line III—III of FIG. 5A.
Figure 6A:
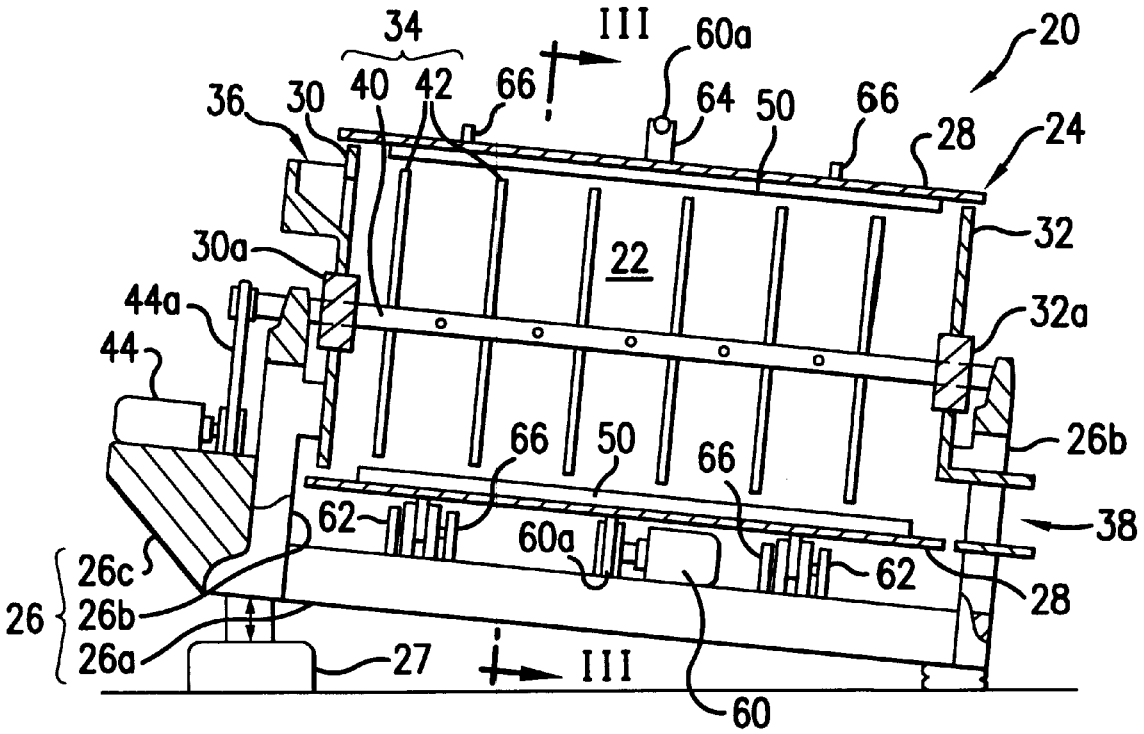
FIG. 6A is a lengthwise, longitudinal sectional view illustrating a crushing apparatus in accordance with a second embodiment of the present invention.
Figure 6B:
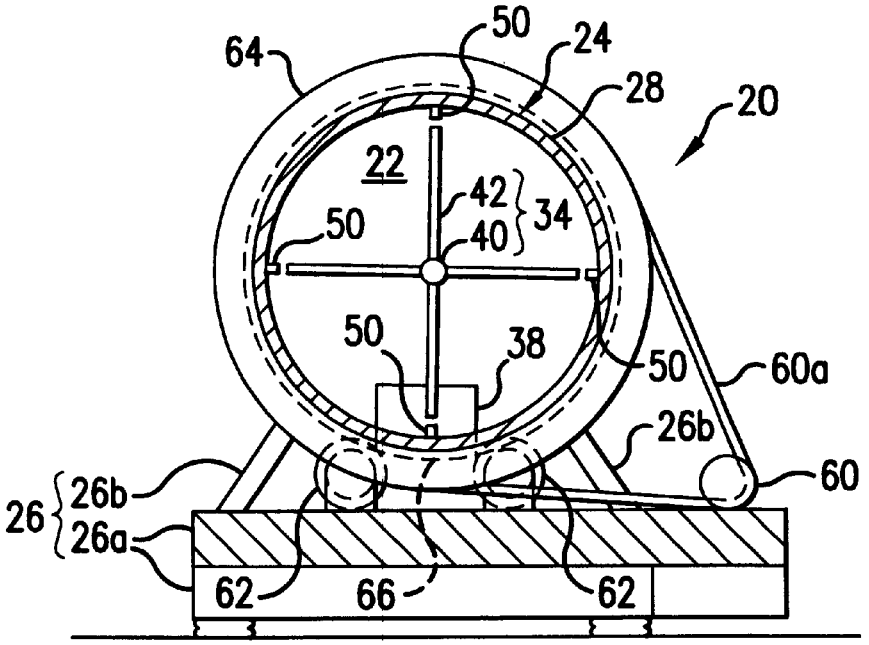
FIG. 6B is a longitudinal sectional view at the line III—III of FIG. 6A.
Figure 7:
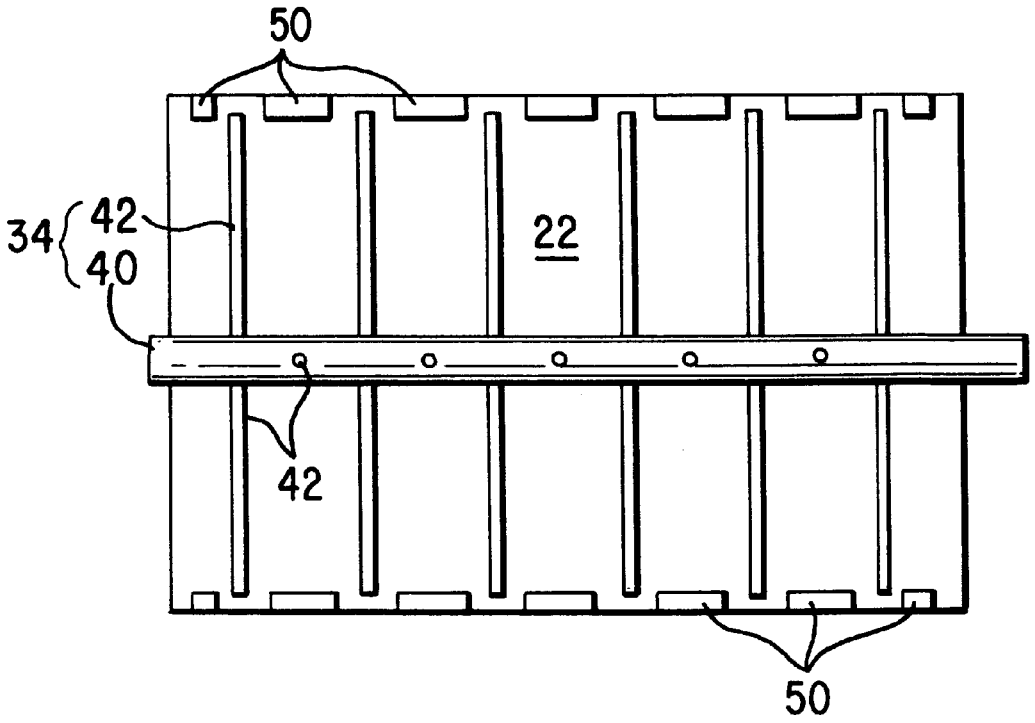
FIG. 7 is a schematic representation illustrating the lengthwise positional relationship between a protuberance and a crushing roll in another form in a processing space of a crushing assembly.
Figure 8:
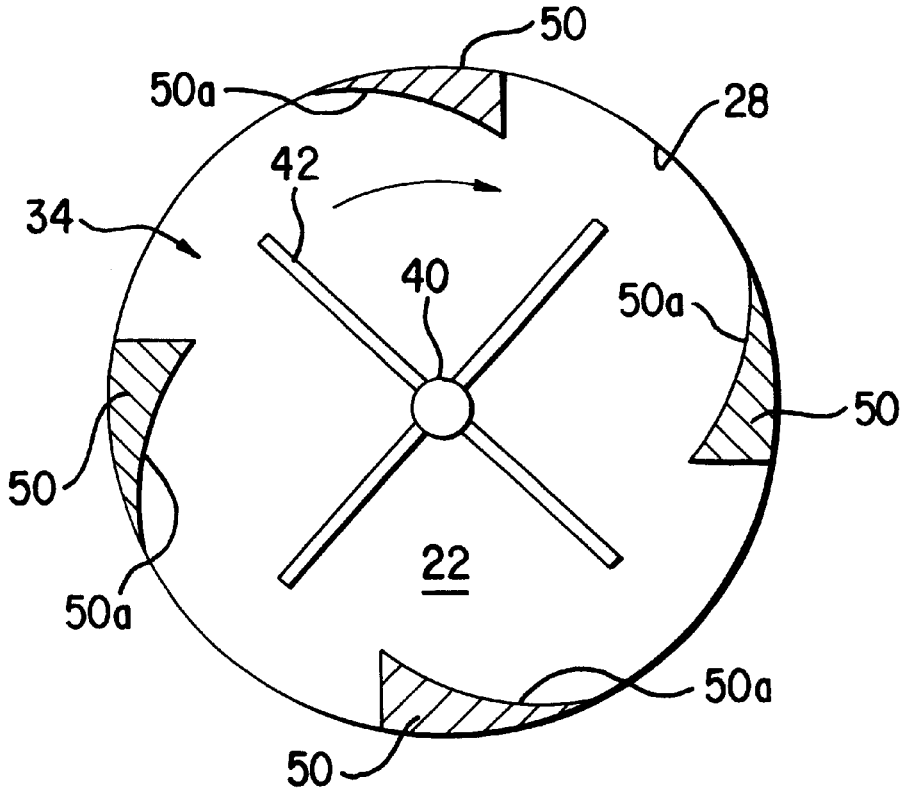
FIG. 8 is a schematic representation illustrating the positional relationship on a rotary plane between the protuberance and the crushing roll in another different form.
Figure 9A:
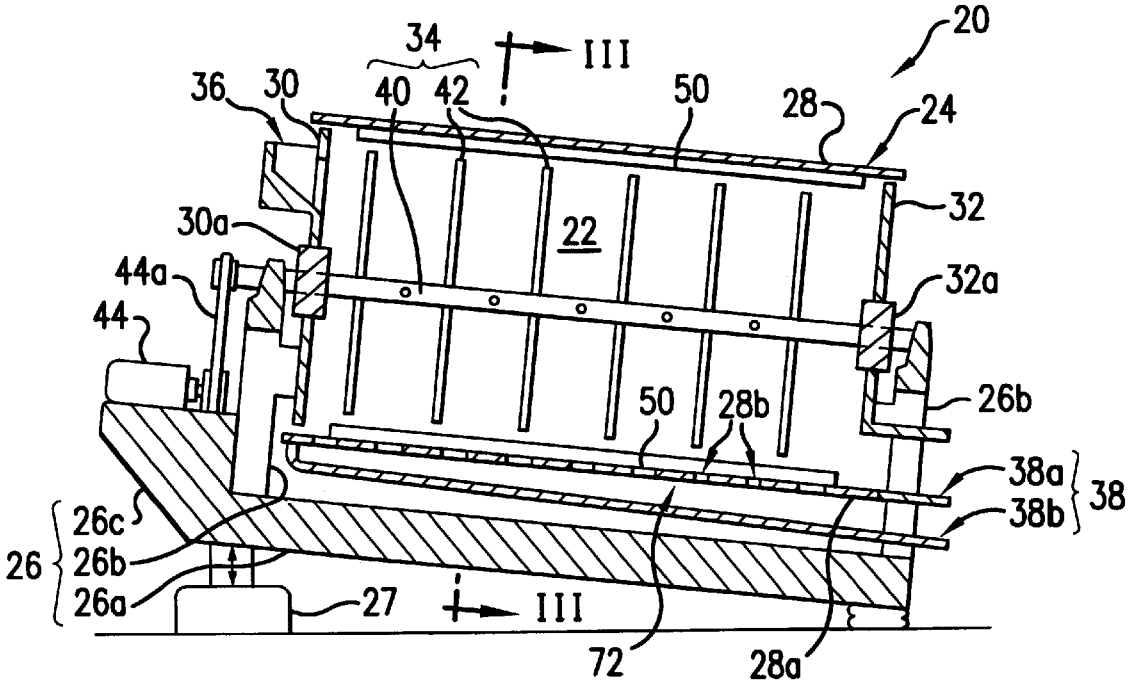
FIG. 9A is a lengthwise, longitudinal sectional view illustrating a crushing apparatus in accordance with a third embodiment of the present invention.
Figure 9B:
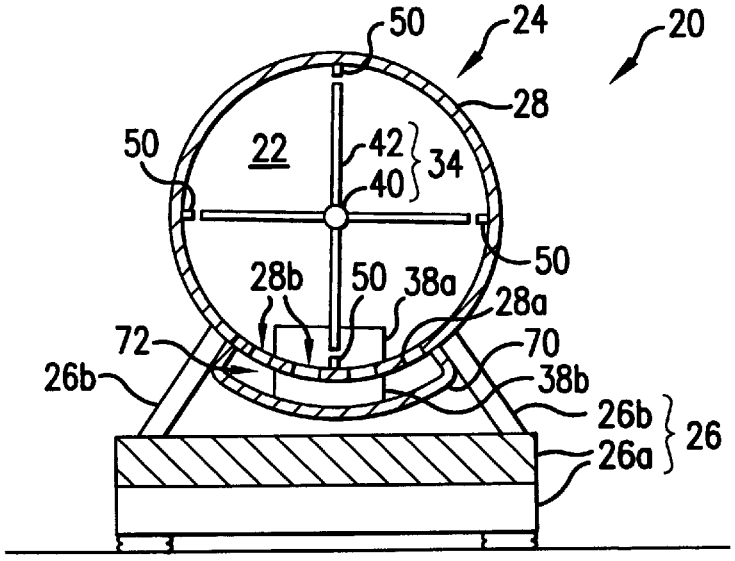
FIG. 9B is a longitudinal sectional view at the line III—III of FIG. 9A.

To describe the crushing process, four embodiments of the heat exchanger crushing apparatus in accordance with the present invention will be described in detail in conjunction with the accompanying drawings. FIG. 1A is a lengthwise, longitudinal sectional view illustrating a crushing apparatus in accordance with a fourth embodiment of the present invention, and FIG. 1B is a longitudinal sectional view at the line III—III of FIG. 1A; FIG. 5A is a lengthwise, longitudinal sectional view illustrating a crushing apparatus in accordance with a first embodiment of the present invention, and FIG. 5B is a longitudinal sectional view at the line III—III of FIG. 5A; FIG. 6A is a lengthwise, longitudinal sectional view illustrating a crushing apparatus in accordance with a second embodiment of the present invention, and FIG. 6B is a longitudinal sectional view at the line III—III of FIG. 6A; FIG. 7 is a schematic representation illustrating the lengthwise positional relationship between a protuberance and a crushing roll in another form in a processing space of a crushing section; FIG. 8 is a schematic representation illustrating the positional relationship on a rotary plane between the protuberance and the crushing roll in another different form; FIG. 9A is a lengthwise, longitudinal sectional view illustrating a crushing apparatus in accordance with a third embodiment of the present invention, and FIG. 9B is a longitudinal sectional view at the line III—III of FIG. 9A.

First Embodiment

A heat exchanger crushing apparatus 20 according to the first embodiment shown in FIGS. 5*a* and 5*b* is roughly composed of a crushing assembly 24 which has a processing space 22 therein to crush the heat exchanger 2 which has been rolled as set forth above, and a base assembly 26 which holds the crushing assembly 24 at a predetermined angle and on which a motor or other driving equipment is fixed.

The crushing assembly 24 is constituted by: a cylindrical peripheral wall 28; an upper cover 30 which closes the open surface on the side of the slant top end of the peripheral wall 28; a lower cover 32 which closes the open surface on the side of the slant bottom end; and a crushing roll 34 which is axially rotatably supported around the processing space 22 in the crushing assembly 24 via a bearing 30*a* provided at the center of the upper cover 30 and a bearing 32*a* provided at the center of the lower cover 32.

At the top side of the upper cover 30, there is an inlet 36 through which a heat exchanger 2, which has been rolled, is fed; the inlet 36 is in communication with the processing space 22. At the bottom end of the lower cover 32, there is a recovering port 38 through which the materials produced from the scrapped heat exchanger 2 is discharged out of the apparatus and recovered.

The crushing roll is composed of a shaft 40 which penetrates the processing space 22 along the axial center thereof and the slant top and bottom ends of which slightly jut out of the upper cover 30 and the lower cover 32, respectively, and a plurality of blades 42 projected from the shaft fully in the processing space 22. As shown in FIG. 5B, both ends of the shaft 40 of the crushing roll 34 are respectively rotatably supported by the bearing at a predetermined angle relative to the horizontal by a support leg 26*b* which spreads toward a bottom plate 26*a* of the base assembly 26. There is no particular restrictions on the angles of the crushing roll 34 and the crushing assembly 24; however, the angles must be sufficiently large to enable the materials produced from the scrapping to be moved down and ejected by their own weight. The shape of the base assembly is not limited to the one shown in the drawing as long as it is able to support the crushing roll.

The base assembly 26 is equipped with a slant support section 27 which supports the slant top end of the bottom plate 26*a* from bottom and which permits the supporting position to be moved up or down. A flange 26*c* with a flat top surface is projected outward from the slant top end of the bottom plate 26*a;* on the top flat surface of the flange 26*c,* a driving equipment such as a motor 44 for running the crushing roll is installed with the drive shaft thereof directed inward. As shown in FIG. 5A, the slant top end of the shaft 40 extended further outward from the shaft end position of the support leg 26*b* is linked to the drive shaft of the installed motor 44 via a belt 44*a*. The linking method is not limited to the one illustrated; the slant top end of the shaft 40 may, for example, be rotatably connected coaxially or via a speed change gear or the like to the drive shaft of the motor 44 to enable rotation at a predetermined speed. Obviously, the number of revolutions of the motor 44 is not restricted.

As illustrated in FIG. 5B, the blades 42 of the foregoing crushing roll 34 are arranged radially around the shaft 40, e.g. in four directions at equal intervals as observed from the axial center; when they are observed from the lengthwise direction of the shaft 40, they are arranged in multiple rows as illustrated by the example of FIG. 5A wherein they are arranged in six rows vertically at equal intervals and in five rows at the midpoints of the foregoing intervals perpendicular to the paper surface. Obviously, there are no restrictions on the number of the blades around the shaft 40 observed from the axial center or the number of rows observed lengthwise. It is necessary, however, to consider the weight balance because the crushing roll 34 is a member which rotates at high speed.

There is no particular restriction on the material used for the blades 42. The blades need not be stiff; they may hang down while at rest and extend sideways during high speed rotation as shown in FIG. 5A or 5B to block the course of the heat exchanger 2 which moves down in the processing space 22.

The operation of the crushing apparatus 20 of the heat exchanger in accordance with the present invention thus composed will now be described.

Figure 13:
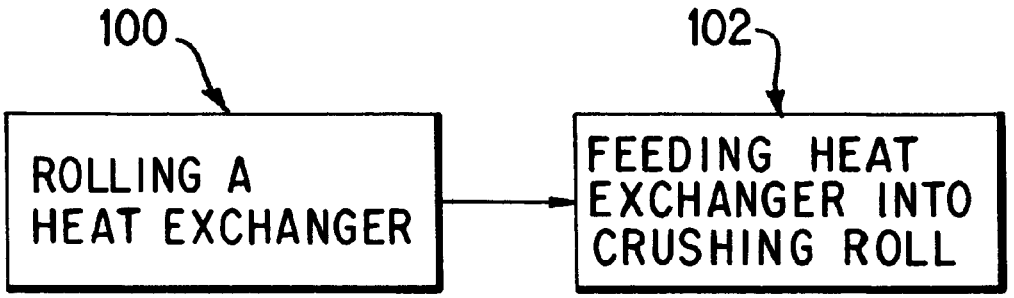
FIG. 13 is a schematic representation of a method for recycling a heat exchanger according to the present invention.

When the heat exchanger 2 which has been subjected to the rolling process is supplied through the inlet 36 shown in FIG. 5A, it drops into the processing space 22 of the crushing assembly 24; in the course of its moving down, the rolled heat exchanger 2 is hit by the blades 42 that fully spread in the processing space 22 and which rotate around the shaft 40. FIG. 13 generally illustrates the method according to the present embodiment wherein a heat exchanger is rolled in step 100, ten fed into a crushing roll in step 102. As the heat exchanger 2 is repeatedly hit by the turning blades 42, it is gradually scrapped due to the impact applied when being hit by the blades 42. To be more specific, when the heat exchanger 2 is hit by the blades 42, the radiating metal fin 4*a* is removed from the hit portion of the heat exchanger 2, and the removed radiating metal fin formed into pieces fall. The heat exchanger 2 which is still relatively large is apt to be moved up by the turning blades 42; it gradually moves down aslant as it is repeatedly moved up and down. Meanwhile, since the blades 42 turn at relatively high speed and they are projected in multiple rows in the direction of the axial center of the shaft 40, the heat exchanger 2 is evenly subject to many impacts applied by the blades 42 and gradually grows smaller. The heat exchanger 2 which is gradually scrapped as set forth above is separated into the copper pipe 6 which has been pressed flat by rolling and the broken pieces of the radiating metal fin 4*a* in the final step. As previously described, there are no particular restrictions on the tilt angle of the crushing assembly 24, the number of revolutions of the crushing roll 34, and the arrangement and the number of the blades 42; however, they are generally preset to appropriate values according, for example, to the size or the degree of scrapping of the heat exchanger 2 so as to ensure the completion of the scrapping by the time the heat exchanger 2 finishes its travel to the slant bottom end. After completion of the scrapping of the heat exchanger 2, the copper pipe 6 and the pieces of the radiating metal fin 4*a* which have been separated from each other are ejected by their own weight through the foregoing recovering port 38 due to the tilt angle and recovered as the scraps to be recycled.

It should be noted that there is no particular restrictions on any other matters than those referred to in the description of this embodiment, and a variety of modifications are possible within the scope of the present invention. For instance, the crushing assembly 24 need not be a hollow cylinder; it may alternatively be a nearly conical trapezoid or the like which tapers toward the recovering port 38 since the heat exchanger 2 gradually grows smaller.

Second Embodiment

The crushing apparatus in accordance with this embodiment is provided with projections on the inner surface of the peripheral wall in order to improve the crushing efficiency; and the peripheral wall is so designed that it is able to rotate independently of the crushing roll. This crushing apparatus shares the same basic structure with the crushing apparatus according to the first embodiment illustrated in FIG. 5A and FIG. 5B described above; therefore, same reference numerals will be given to repeated constituent elements, and the description thereof will be omitted.

As shown in FIG. 6A and FIG. 6B, the inner surface of the peripheral wall 28 forming the processing space 22 is provided with a plurality of protuberances 50 which jut out inward. The respective protuberances 50 are intended, for example, to apply further impact to the heat exchanger 2 which has been hit by the blades 42 bounced outward so as to enhance the scrapping efficiency or to prevent the heat exchanger 2 from undesirably slipping down, taking a shortcut on the wall surface. In most cases, an object which has come into contact with a rotating body is bounced back in the tangent direction; hence, it is preferable to provide each protuberance 50 with large side surface areas so as to permit impact to be applied easily to the heat exchanger 2. For this reason, it is desirable that the protuberances 50 are composed of ribs which extend at an angle, and which have rectangular cross sections, for example, four protuberances 50 being arranged at intervals of 90 degrees as observed from the rotating plane as illustrated; however, there is no particular restrictions on the specifications including the number of the protuberances 50 because the effect for applying impact can be obtained as long as they jut out more or less. For instance, the protuberances 50 may be provided at an angle in a discrete fashion as shown in FIG. 7. This arrangement makes it possible to narrow the gap between the blades 42 and the peripheral wall 28 of the crushing assembly 24 as compared with the case of the ribs illustrated in FIG. 6; therefore, it is advantageous in that the spacial allowance through which the heat exchange 2 undesirably slips down through a shortcut on the wall surface before it is crushed can be minimized so as to improve the crushing efficiency and that the apparatus can be made smaller. Furthermore, the ribs may be provided in the circumferential direction or may be extended aslant, or projections may be arranged in a predetermined pattern or scattered at random.

The improvement of the efficiency for scrapping the heat exchanger 2 by the protuberances 50 can be achieved by using a different method from the method wherein the impact is applied by the protuberances 50. For instance, when the protuberances 50 are arranged extensively at an angle as illustrated in FIG. 6, the heat exchanger 2 lying on the bottom of the peripheral wall 28 of the crushing assembly 24 may be moved up by rotating the peripheral wall 28, then put back into the processing space 22 by making use of the fall of the heat exchanger 2.

As another alternative, the chances of applying impact by the crushing roll 34 by utilizing the operation of the protuberances 50 may be increased rather than making an attempt to increase the magnitude of the impact applied by the protuberances 50. As illustrated in FIG. 8, for instance, all the protuberances 50 are provided with gentle slopes 50*a,* which continue from the inner surface of the peripheral wall 28, on the sides thereof toward which the crushing roll 34 approaches. This makes it possible to put the heat exchanger 2, which has been hit by the blades 42 of the crushing roll 34 and bounced outward, back into the rotary space of the crushing roll 34 along the slopes 50*a.* There is no particular restrictions on the number, the layout, the longitudinal length, or shape of the protuberances 50 shown in FIG. 8. The cross-sectional shape of the protuberances 50 is not limited to that shown in FIG. 8; the minimum requirement for this purpose is that the protuberances 50 have at least slopes 50*a,* and the protuberances 50 may be made of leaves having the slopes 50*a* as the inner surfaces thereof.

The crushing assembly 24 according to the present embodiment is formed so that it is able to rotate independently of the crushing roll 34 previously described. More specifically, as shown in FIGS. 6A and 6B, one of the side surfaces of the bottom plate 26*a* of the base assembly 26 is made wider. Mounted on the top surface of the wider portion of the bottom plate 26*a* is a power equipment such as a motor 60 for running the crushing assembly, which is separate from and independent of the motor 44 for running the crushing roll described above; the power equipment is installed so that the drive shaft thereof is nearly parallel to the slanting direction of the crushing assembly 24. Further, a total of four pulleys 62 are fixed on the top surface of the bottom plate 26*a* under the crushing assembly 24 on both sides in the slanting direction with the motor 60 therebetween, two each in the direction approximately orthogonal relative to the slanting direction.

Provided around the outer surface of the peripheral wall 28 is a belt receiver 64 installed near the center in the lengthwise direction of the peripheral wall 28. A recessed portion in which a motor belt can be engaged is formed at the lug end of the belt receiver 64. Rotary ribs 66 which can be engaged with the pulleys 62 are provided around the peripheral wall 28 on both sides in the slanting direction with the belt receiver 64 therebetween. The belt receiver 64 is connected to the motor 60 by the belt 60*a;* and the rotary ribs 66 are rotatably engaged with the pulleys 62. The connecting method is not limited to the one illustrated; a gear, for example, may be used for the connection. When a gear is used, a single or a plurality of speed change gears may be engaged between the motor 60 and the crushing assembly 24. Further alternatively, the pulleys 62 may be driven directly by the motor. It is needless to say that there is no restrictions on the position or shape of the belt receiver 64 or the positions or number of the pulleys 62.

When crushing the heat exchanger 2 by employing the crushing apparatus 20 thus configured, the heat exchanger 2 put in the apparatus is hit by the protuberances 50 provided on the peripheral wall 28 of the crushing assembly 24 when it is bounced in the circumferential direction by the blades 42 or moved back into the rotary space of the crushing roll 34, so that the scrapping efficiency is improved. Moreover, the peripheral wall 28 itself turns independently to strike the heat exchanger 2; hence, the scrapping efficiency is higher than that obtained in the first embodiment, and the apparatus can be made even smaller.

Third Embodiment

The crushing apparatus according to this embodiment is equipped with a mechanism for screening the copper pipe 6 and the radiating metal fin 4*a* by making use of their different shapes, in addition to the mechanism for crushing the heat exchanger which has been described so far. The crushing apparatus of the third embodiment also shares the same basic construction with the crushing apparatus according to the embodiments illustrated in FIGS. 5A and 5B and FIGS. 6A and 6B; hence, same reference numerals are assigned to repeated constituent elements and the description thereof will be omitted.

Figure 10A:
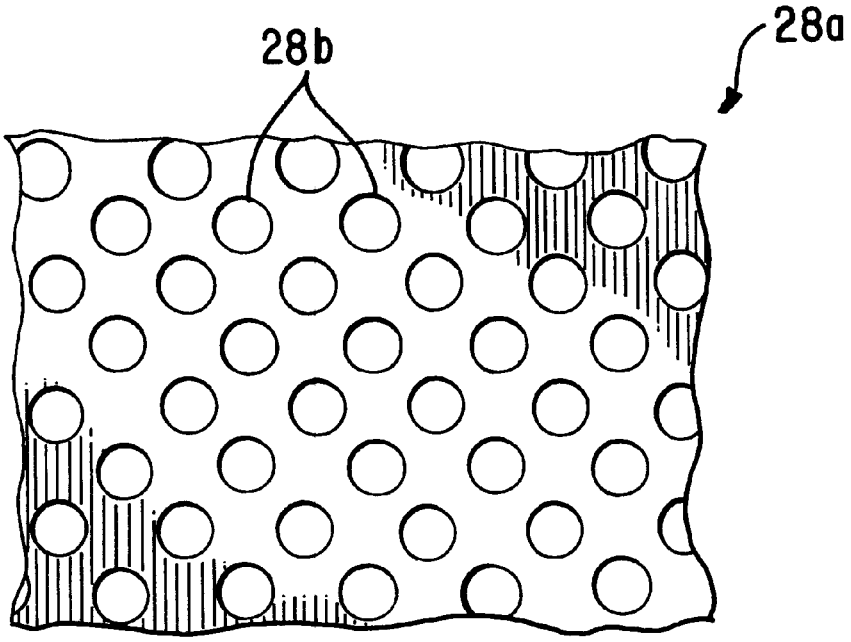
FIGS. 10A and 10B are top plan views illustrating a partial cutout of an inner wall (28*a*) of a peripheral wall (28) which has many meshes for screening.
Figure 10B:
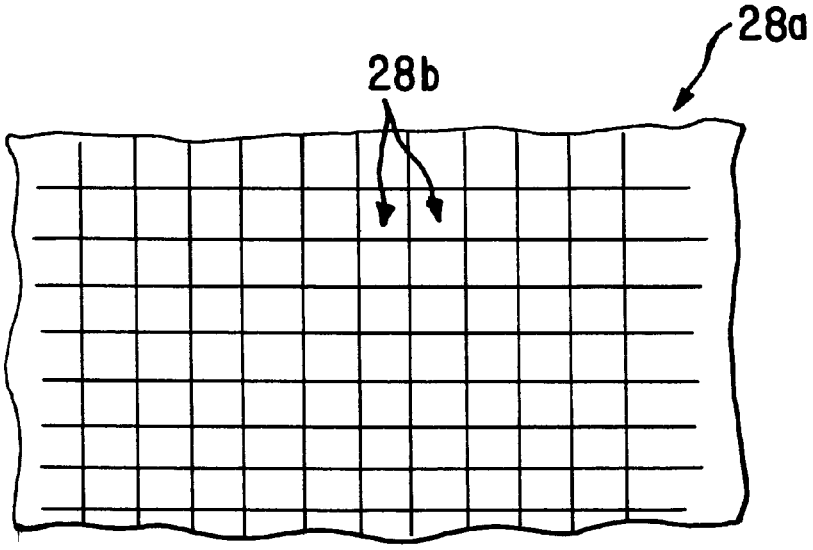

As shown in FIG. 9A and FIG. 9B, the crushing apparatus 20 according to the third embodiment has a double-wall structure composed of a slanting bottom portion, namely, an inner wall 28*a,* of the peripheral wall 28, and an outer wall 70 which slants and continues therefrom on the outer side of the inner wall 28*a.* As illustrated in FIGS. 10A and 10B, the inner wall 28*a* is provided with many meshes 28*b* to form a screen which selectively allows the radiating metal fin 4*a* to pass therethrough with respect to the foregoing copper pipe 6 as shown in FIGS. 10A and 10B. The recovering port 38 at the bottom end of the dual wall is divided to a copper pipe recovering port 38*a* for recovering the copper pipe 6, which port communicates the processing space 22 in the inner wall 28*a* to the outside, and a radiating metal fin recovering port 38*b* for recovering the radiating metal fin 4*a,* which port communicates an internal space 72 of the dual wall to the outside. In the example shown in FIG. 9B, the slant bottom area of the peripheral wall 28 composed of the dual wall is set to about 45 degrees as observed from the rotary plane; however, the angle is not limited thereto, and the shape, intervals, etc. of the meshes 28*b* are not limited to those shown in the drawings.

In the crushing apparatus 20 of the third embodiment, as the crushing of the heat exchanger 2 proceeds, the copper pipe 6 which is relatively large moves down by its own weight due to the slant and it is ejected through the copper pipe recovering port 38*a* and the radiating metal fin 4*a* which is relatively small moves down by its own weight due to the slant and it is ejected through the radiating metal fin recovering port 38*b.* According to the crushing apparatus 20 of this embodiment, the subsequent sorting process is implemented while crushing process is carried out at the same time, enabling even more efficient crushing of the heat exchangers to be achieved.

There is no particular restrictions on the matters other than those described in the embodiment, and a variety of modifications are possible within the scope of the present invention. For instance, in order to improve the sorting efficiency, vibration may be applied to the inner wall 28*a* by power equipment, not shown, thereby employing the inner wall 28*a* as a vibrating screen.

Fourth Embodiment

The crushing apparatus according to a fourth embodiment has further developed the third embodiment to provide the entire peripheral wall 28 with the dual wall. The peripheral wall 28 of this embodiment rotates as in the case of the second embodiment. The crushing apparatus of the fourth embodiment shares the same basic structure with the crushing apparatus according to the embodiments illustrated in FIGS. 5A and 5B, FIGS. 6A and 6B, and FIGS. 9A and 9B; hence, same reference numerals are assigned to repeated constituent elements and the description thereof will be omitted.

The entire peripheral wall 28 of the crushing apparatus 20 according to this embodiment has the double-wall structure as illustrated in FIG. 1. The inner wall 28*a* of the dual wall is provided with many meshes 28*b* for the screening illustrated in FIGS. 10A and 10B. As in the case of the second embodiment previously described, the base assembly 26 is equipped with the motor 60 for running the crushing assembly. The belt 60*a* of the motor 60 is retained on the belt receiver 64 provided around the outer wall 70.

In the crushing apparatus 20 of this embodiment, the entire peripheral wall 28 including the screen-like inner wall 28*a* can be rotated independently of the crushing roll 34, so that the inner wall 28*a* is employed as the rotary screen to improve the sorting efficiency. As illustrated, the protuberances 50 are provided on the inner side of the inner wall 28*a* to accomplish higher crushing efficiency as in the case of the second embodiment. Thus, the use of this crushing apparatus 20 makes it possible to crush and sort the copper pipes 6 and the radiating metal fins 4*a* with extremely high efficiency.

There is no restrictions on the number of revolutions of the peripheral wall 28. If, however, the number of revolutions of the peripheral wall 28 of the crushing apparatus 20 is increased excessively, then the radiating metal fin 4*a* which has dropped into the internal space 72 of the dual wall may be undesirably moved up back into the processing space 22; this should be taken into account when deciding the number of revolutions of the peripheral wall 28.

There is no particular restrictions on the matters other than those described in the embodiment, and a variety of modifications are possible within the scope of the present invention. For instance, a spiral partitioning wall or other similar means may be provided in the internal space 72 of the dual wall to prevent the radiating metal fin 4*a* which has fallen in the internal space 72 of the dual wall from being moved back into the processing space 22, thereby ejecting the radiating metal fin 4*a* through the radiating metal fin recovering port 38*b* before it is moved up. Alternatively, the inner wall 28*a* may be rotatably supported with respect to the outer wall 70, and the belt 60*a* may be retained on the inner wall 28*a* so that only that portion is rotated by the motor 60. In this case, the object of the embodiment described above can be attained, and still higher efficiency can be achieved also because the number of revolutions can be increased since the radiating metal fin 4*a* is prevented from being moved back to the processing space 22.

Figure 11:
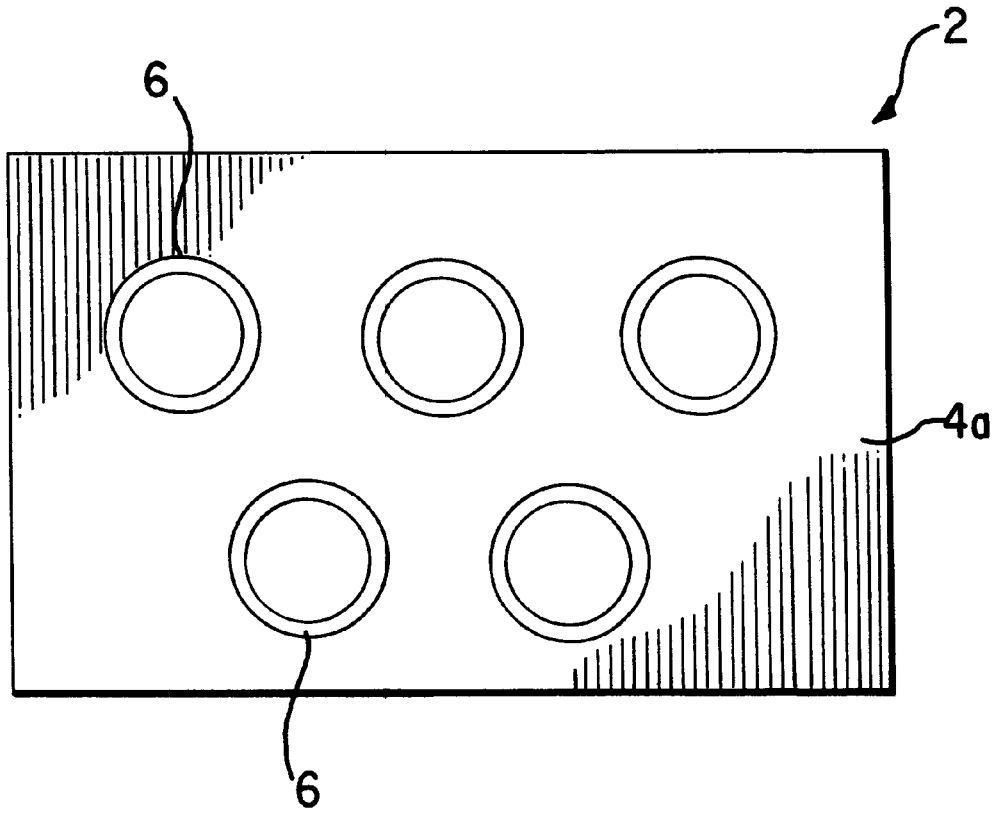
FIG. 11 is a side view illustrating another heat exchanger which can be scrapped by the heat exchanger recycling method in accordance with the present invention.

FIG. 11 illustrates a cutout surface of another heat exchanger which can be scrapped using the recycling method in accordance with the present invention. The heat exchanger 2 shown in the drawing has the copper pipes 6 arranged in two rows, upper and lower. A plurality of the copper pipes 6 arranged as illustrated can be also scrapped by the recycling method in accordance with the present invention.

Sorting

The sorting process need not be carried out independently when the aforesaid screening mechanism is provided to perform the sorting process while performing the crushing process at the same time; in other cases than this, the radiating metal fins 4*a* and the copper pipes 6 which have been separated into pieces by the crushing process are sorted in this sorting process by making use of the differences in shape or physical properties thereof.

In the sorting process, the constituent elements produced by scrapping the heat exchanger 2 are let go through a screen, for example, which has meshes that allow the largest one among the radiating metal fins 4*a* separated by the preceding crushing process to pass therethrough. The radiating metal fins 4*a* separated from the scrapped heat exchanger 2 pass through the foregoing screen, while the copper pipes 6 do not pass through the screen, thus making it possible to separate the radiating metal fins 4*a* and the copper pipes 6. The slant fixed screen may be replaced by a vibrating screen; the use of the vibrating screen enhances the sorting efficiency because the vibration enhances the scrapping of the heat exchanger 2.

Instead of the sorting method using the screen, other methods including a heavy liquid separation method may be employed; the heavy solution sorting method utilizes the difference in specific gravity between the aluminum used for the radiating metal fin 4*a* and the copper used for the copper pipe 6. The specific gravity of aluminum is approximately 2.71 and the specific gravity of copper is approximately 8.92; hence, a solution of ethane tetrabromide or the like which has a specific gravity larger than 2.71 and ferrosilicon, magnetite, or other which has been crushed approximately to 200 mesh are used to prepare a suspensoid media having a specific gravity of 2.71 or more. The materials produced from the scrapping process are put in the heavy or suspensoid media so as to sort the radiating metal fin 4*a* as a suspension and the copper pipe 6 as a sediment, thus enabling these two different parts to be separated and recovered. As another alternative, air separation or water separation may be employed, which makes use of the differences in specific gravity or shape between the radiating metal fin 4*a* and the copper pipe 6 of the scrapped heat exchanger.

EXAMPLES

The present invention will be described in conjunction with further specific examples. It should be noted, however, that the present invention is not limited to the examples set forth below.

First Example

In the heat exchanger recycling method according to this example, the heat exchanger 2 composed of a flat plate measuring 120 mm×300 mm×22 mm (a×b×c) and weighing 365 grams was employed. The heat exchanger 2 cut out in this size had eight copper pipes 6; each copper pipe 6 had an outside diameter d of 10.2 mm and a wall thickness e of 0.5 mm. The copper pipes 6 were arranged in a row with a distance f of approximately 15.3 mm provided between adjoining copper pipes 6 as shown in FIG. 3.

Preprocessing

The support metal fittings mounted on the heat exchanger 2 were cut off and removed by using a metallic saw.

Rolling

The heat exchanger 2 was rolled in a direction orthogonal to the axial direction of the copper pipes 6 by using a roiling machine with a maximum load of 150 tons. The rolling machine had a rolling speed of 10 m/min. and a rolling gap of 0.4 mm. The heat exchanger 2 was rolled to measure 127 mm×450 mm×0.85 mm, the weight thereof being 365 grams.

At this time, the diameter of the rolled copper pipe 6 in the rolling direction was approximately 27.4 mm. In other words, the ratio of the outside diameter of the rolled copper pipe 6 in the rolling direction relative to the outside diameter 10.2 mm of the copper pipe 6 before rolling was 2.69.

Crushing

Figure 12A:
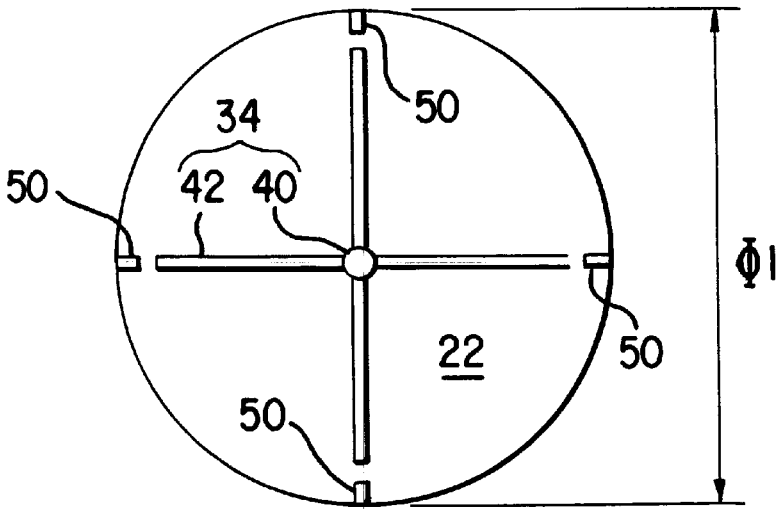
FIG. 12A is a dimensional schematic representation illustrating the internal space of the crushing apparatus used in the embodiments which is observed from a rotary plane.
Figure 12B:
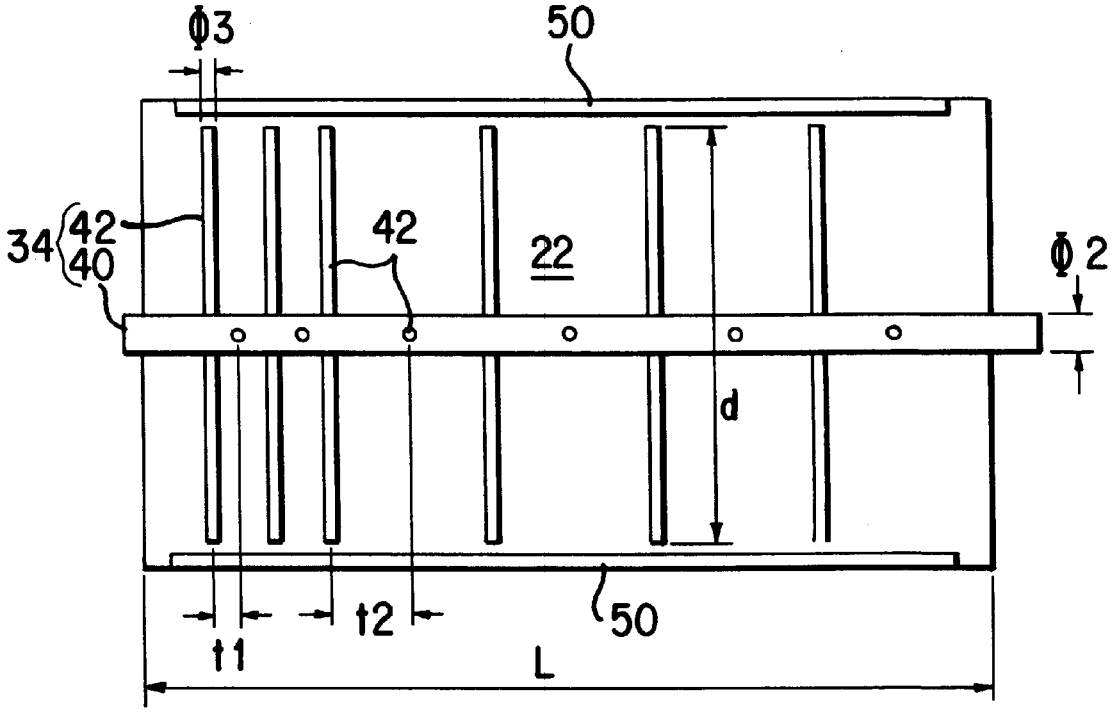
FIG. 12B is a dimension al schematic representation illustrating the internal space observed lengthwise.

The crushing apparatus 20 according to the second embodiment shown in FIGS. 6A and 6B was employed; the specifications thereof were as shown below (the reference numerals of the constituent elements are as shown in FIG. 12).

Crushing assembly . . . Volume of outer wall: 954 liters (ϕ1: 960×L: 1500 mm)

Crushing roll . . . The one shown in FIG. 12 was used.

Shaft . . . ϕ2 : 60 mm

Blade . . . ϕ3 : 13 mm iron stranded wire (Passed through the shaft 40 and fixed)

No. of blades: 12 length d: 880 mm

Pitch t1: 30 mm (4 blades at the inlet 36) t2: 75 mm (remaining 8 blades)

Before implementing the crushing process using this crushing apparatus 20, conditioning was studied. From the result, it is revealed that the number of revolutions of the crushing roll 34 must be 400 rpm or more to accomplish satisfactory separation, and the number of revolutions of the peripheral wall 28 must be 3 rpm or more to accomplish satisfactory sorting. It was also found that setting the tilt angle of the crushing assembly 24 to 2 degrees or more causes the scraps to move down and eject by their own weight. Based on the finding, the following crushing conditions were established.

No. of revolutions of crushing roll: 600 rpm

No. of revolutions of peripheral wall: 5 rpm

Tilt angle of crushing assembly: 6 degrees

Under the condition shown above, the rolled heat exchanger 2 weighing 365 grams was fed to the crushing apparatus 20 illustrated in FIGS. 6A and 6B, and the scraps obtained through the recovering port 38 were manually sorted to three types, namely, copper, aluminum, and a mixture of copper and aluminum. As a result, flat copper pieces of 163 grams and aluminum pieces of 200 grams were obtained, and no mixture of the two was found.

Second Example

In this example, the crushing apparatus 20 according to the fourth embodiment shown in FIGS. 1A and 1B was used. The mesh 28*b* of the inner wall 28*a* was 25 mm in diameter. The rest of the devices and processing conditions were identical to those of the first example described above.

As in the case of the first example, the rolled heat exchanger 2 weighing 365 grams was fed to the crushing apparatus 20 shown in FIGS. 1A and 1B, and the scraps obtained through the copper pipe recovering port 38*a* and the radiating metal fin recovering port 38*b* were manually sorted to three types, namely, copper, aluminum, and a mixture of copper and aluminum. The result indicated that the scraps obtained through the recovering ports 38*a* and 38*b* exhibited the good quality as shown below.

(1) Copper pipe recovering port Flat plate-shaped copper: 167 grams Aluminum pieces or mixture of copper and aluminum: None (2) Radiating metal fin recovering port Aluminum pieces: 195 grams Copper pieces or mixture of copper and aluminum: None Thus, the heat exchanger crushing apparatus in accordance with the present invention is capable of separating a large volume of radiating metal fins and metal pipes of heat exchangers in succession. This greatly helps to establish a method for easily recycling heat exchangers at lower cost.

What is claimed is:

1. A method for recycling a heat exchanger which includes at least one pipe penetrating a plurality of fins, comprising the steps of:

rolling a heat exchanger so as to spread, in a predetermined direction, an outer periphery of at least one metal pipe penetrating at predetermined intervals, a plurality of radiating metal fins of said heat exchanger; and feeding the heat exchanger into a rotary space of a crushing roll which rotates about a longitudinal axis, said axis being inclined at a predetermined angle so as to separate said at least one metal pipe from said plurality of radiating metal fins.

2. A heat exchanger separating apparatus comprising:

a crushing chamber with a peripheral wall, said peripheral wall defining a processing space;

an inlet which opens on the side of the top of said crushing chamber and through which a heat exchanger is supplied, wherein a lower portion of said peripheral wall slants downward from said inlet at a predetermined angle and wherein at least a portion of said peripheral wall comprises a mesh portion which is configured to allow separated metal fins of a heat exchanger to pass therethrough while preventing metal pipes from the heat exchanger from passing; and a crushing roll which rotates about a longitudinal axis in said crushing chamber and which communicates with said heat exchanger fed into the processing space, wherein said crushing roll comprises:

a shaft assembly which extends in a slanting direction of said processing space and which rotates about an axis thereof; and a plurality of blades which are projected radially around a circumference of said shaft assembly in multiple rows in a lengthwise direction of said shaft assembly, and each of which turns in said processing space as said shaft assembly rotates so as to hit said heat exchanger.

3. A heat exchanger separating apparatus according to claim 2, wherein said peripheral wall of said crushing chamber is provided with a single or a plurality of protuberances which jut out into said processing space.

4. A heat exchanger separating apparatus according to claim 3, further comprising tilt angle adjusting means which permits said predetermined angle to be adjusted.

5. A heat exchanger separating apparatus according to claim 2 or 3, wherein the peripheral wall of said crushing chamber is arranged so that it is capable of axial rotation independent of said crushing roll.

6. A heat exchanger separating apparatus according to claim 5, further comprising tilt angle adjusting means which permits said predetermined angle to be adjusted.

7. A heat exchanger separating apparatus according to claim 2 or 3, wherein said crushing chamber further comprises:

an outer wall provided outside of said mesh portion, said outer wall and said mesh portion defining an internal space therebetween;

a metal pipe recovering port provided on a bottom end of said crushing chamber, which communicates the processing space inside said crushing chamber to the outside of the apparatus; and a radiating metal fin recovering port which communicates said internal space to the outside of the apparatus.

8. A heat exchanger separating apparatus according to claim 7, further comprising tilt angle adjusting means which permits said predetermined angle to be adjusted.

9. A heat exchanger separating apparatus according to claim 7, wherein said outer wall extends circumferentially around said peripheral wall, and wherein the peripheral and outer walls are arranged so that they are capable of axial rotation independently of said crushing roll.

10. A heat exchanger separating apparatus according to claim 9, further comprising tilt angle adjusting means which permits said predetermined angle to be adjusted.

11. A heat exchanger separating apparatus according to claim 2, further comprising tilt angle adjusting means which permits said predetermined angle to be adjusted.

* * * * *